United States Patent [19]

Törmänen

[11] Patent Number: 4,861,431

[45] Date of Patent: Aug. 29, 1989

[54] APPARATUS IN A CANTILEVERED FRAME PART OF A PAPER MACHINE

[75] Inventor: Aimo Törmänen, Jyväskylä, Finland

[73] Assignee: Valmet Paper Machinery, Inc., Finland

[21] Appl. No.: 278,187

[22] Filed: Nov. 30, 1988

[30] Foreign Application Priority Data

Dec. 3, 1987 [FI] Finland ..... 875332

[51] Int. Cl.[4] ..... D21F 3/02; D21F 1/24

[52] U.S. Cl. ..... 162/273; 162/199; 162/358

[58] Field of Search ..... 162/199, 200, 272, 273, 162/274, 358, 360.1

[56] References Cited

U.S. PATENT DOCUMENTS 4,140,575 2/1979 Wenzl ..... 162/273

4,452,668 6/1984 Vallius et al. ..... 162/274

4,560,441 12/1985 Kraft et al. ..... 162/273

*Primary Examiner*—Karen Hastings

*Attorney, Agent, or Firm*—Steinberg & Raskin

[57] ABSTRACT

Method and apparatus in a cantilevered frame part of a press section and/or wire section of a paper machine in which a cantilevered beam extending between the side frames of the machine is pre-tensioned by applying a force on the cantilevered or projecting part of the beam. The pre-tensioning is produced by a power device, preferably a hydraulic power unit, which produces a downwardly directed pre-tensioning force on the projecting part of the cantilevered beam. The pre-tensioning is applied prior to the replacement of press fabrics or an equivalent operation, and is released after the fabric replacement has been carried out and the side frame at the service side of the machine has been closed or is closeable.

5 Claims, 2 Drawing Sheets

FIG. A (PRIOR ART)

APPARATUS IN A CANTILEVERED FRAME PART OF A PAPER MACHINE

BACKGROUND OF THE INVENTION

This relates to methods and apparatus in a cantilevered frame part of a press section and/or wire section of a paper machine in which a cantilevered beam attached between the side frames of the paper machine is pre-tensioned by applying a predetermined force in a downward direction of the projecting part of the cantilevered beam.

It is known in the prior art to provide cantilevered beams as part of the paper machine frame. The cantilevered beams extend in the transverse direction of the paper machine and are arranged in a manner such that at the service side of the paper machine, intermediate pieces situated between the beam and the frame are openable by means of power units. When opened, the intermediate pieces provide an opening through which closed fabric loops of the paper machine can be inserted and positioned around the rolls and cross beams in connection with the replacement of the fabrics. In a manner known in the prior art, the projecting parts of the cantilevered beams which are situated at the other side of the paper machine, i.e., the operation side of the paper machine opposite from the service side at which the openable intermediate pieces are situated, are fixed to the ceiling, wall or floor of the paper machine hall, and most commonly are fastened to projecting parts of the wall of the paper machine hall by means of massive threaded members. The threaded fastening members function to support the cantilevered beam when the intermediate pieces on the service side of the machine frame are opened.

The known manner of fastening the projecting part of the cantilevered beam involves certain drawbacks resulting from the fact that the fastening members are under tension at all times. For this reason, oscillations or vibrations spread from the paper machine frame through the fastening members to the wall construction of the paper machine hall which, among other things, significantly increases the noise level in the paper machine hall.

Another drawback of conventional tensioning fastening arrangements is that the large forces applied by them to the cantilevered beams may cause the long frame beams to deform. This can adversely affect, for example, the parallel alignment of the axles of the various paper machine rolls.

SUMMARY OF THE INVENTION

It is therefore an object of the present invention to provide new and improved methods and apparatus in a cantilevered frame part of a paper machine which will avoid the drawbacks discussed above.

Briefly, in accordance with the present invention, this object, among others, is obtained by providing a method wherein the pre-tensioning of a cantilevered beam is produced by power means, preferably a hydraulic power unit, which applies a downwardly directed pre-tensioning force on the projecting part of the cantilevered beam when the service side of the paper machine frame is opened, such as for replacement of press fabrics or the like, and wherein the pre-tensioning is released after the replacement of the press fabrics or the like has been carried out and the service side of the paper machine frame has been closed or is closeable.

According to the invention, the above-stated object, among others, is also obtained by providing apparatus which, in accordance with a first embodiment, comprises a loading arm connected to the end of the projecting part of the cantilevered beam by means of an articulation shaft; a hydraulic cylinder or the like having one end arranged to act upon the loading arm, and the other end being attached to the upper side of the projecting part of the cantilevered beam. The loading arm is attached to one end of a pull bar by an articulation shaft or the like while the other end of the pull bar is attached to a stationary counter-member and the loading arm is linked to the end of the projecting part of the cantilevered beam.

In a second embodiment, apparatus in accordance with the invention comprises a draw cylinder having a piston which can be withdrawn into the cylinder by adjusting the pressure of a pressure medium to produce pre-tensioning of the beam. The draw cylinder is attached at its top side to the outer end of the projecting part of the cantilevered beam by articulation pins or the like while the bottom side of the draw cylinder is attached to a stationary counter-member, preferably a projecting part of the wall of the paper machine hall.

In a third embodiment, apparatus in accordance with the invention comprises a hydraulic lifting cylinder fitted on or in connection with the top side of the projecting part of the cantilevered beam. The hydraulically displaceable lifting part of the hydraulic cylinder rests against a stationary counter-member, preferably through the intermediate of a press bolster.

In accordance with the invention, the pre-tensioning of the cantilevered beam can be released during normal operation of the paper machine, i.e., when the service side of the machine frame is closed. The pre-tensioning is applied to the cantilevered beam when the service side of the paper machine is opened by removing the intermediate piece or pieces so that any deformation or sag of the cantilevered beam under its own weight will not become unduly large.

DESCRIPTION OF THE DRAWINGS

A more complete appreciation of the present invention and many of the attendant advantages thereof will be readily understood by reference to the following detailed description of preferred embodiments, to which the invention is not limited, in conjunction with the accompanying drawings in which.

FIG. A is a schematic front elevation view in partial section of a cantilevered beam of a frame part of a paper machine and illustrating a pre-tensioning fastening arrangement in accordance with the prior art.

DETAILED DESCRIPTION OF THE PREFERRED EMBODIMENTS

Figure 1:
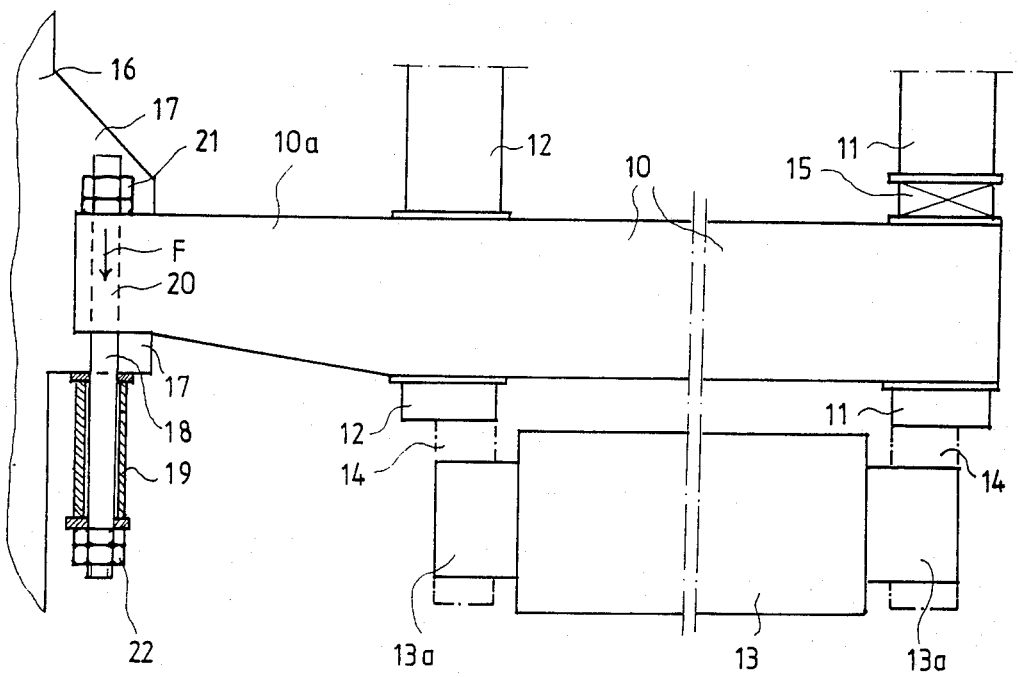
FIG. 1 is a front elevation view in partial section of a first embodiment of apparatus in accordance with the invention in conjunction with a projecting part of a cantilevered beam.
Figure 1:
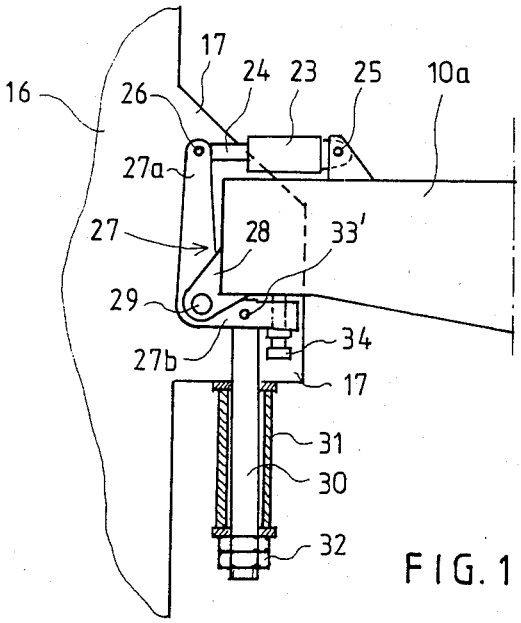

Referring now to the drawings wherein like reference characters designate identical or corresponding parts throughout the several views, and more particularly to FIG. A, a conventional paper machine frame comprises a transverse cantilevered beam 10 extending between opposed side frames of the paper machine, namely, between the service-side side frame 11 and the operation-side side frame 12. In a manner known in the prior art, the projecting part 10*a* of the cantilevered beam 10 at the operation side of the frame is fixed to a projecting part 17 of a wall 16 of the paper machine hall. In particular, the projecting part 10 *a* of cantilevered beam 10 is connected to the projecting part 17 of wall 16 by means of a draw bar 18 that extends through an opening 20 formed through the end of the projecting part 10 *a* of beam 10. The draw bar 18 passes into a box bolster 19 that bears against the flat bottom side of the projecting wall part 17 and is mounted in the paper machine hall in the machine direction. The ends of the draw bar 18 are threaded and nuts 21 are threadedly fastened on the top end of the draw bar to bear against the top surface of the projecting part 10 *a* of beam 10. Similarly, nuts 22 are threadedly fastened on the lower end of the draw bar 18 and bear against the bottom surface of the bolster 19. The nuts 21 and 22 are generally permanently tightened in the illustrated positions to provide a suitable permanent support and pre-tensioning for the beam by virtue of the force F applied to the beam by the nuts 21. On the other hand, the projecting part of the beam applies an equal and opposite force to the bar 18 so that the draw bar 18 is subjected to considerable tensile strain. The bar 18 and nuts 21, 22 are relatively massive and robust members so that it is not practical, and usually not possible, to open the tension fastening arrangement such, for example, as during replacement of a press felt.

Still referring to FIG. A, a press roll 13 of the press section is mounted on the side frames 11 and 12 by its bearings and axle journals 13*a*. The levers and cylinders for loading the press roll 13 are schematically illustrated at 14. Openable intermediate pieces 15 (one shown) are provided as part of the service-side side frame 11. When it is desired to replace a closed loop of press fabric, the intermediate pieces 15 are opened to provide a free space through which a new closed loop of press fabric is inserted and located around the press and guide rolls whereupon the intermediate pieces are closed and the side frame 11 locked. The tensioning fastening means 17, 18, 19, 21, 22 of the projecting part 10*a* of beam 10 is not opened during the replacement operation. Rather, the cantilevered beam 10 ha a certain pre-tension at all times resulting from the permanent force F to reduce the sag of the end of the beam 10 which is proximate to the service-side side frame 11 and to facilitate opening of intermediate pieces 15.

Figure 2:
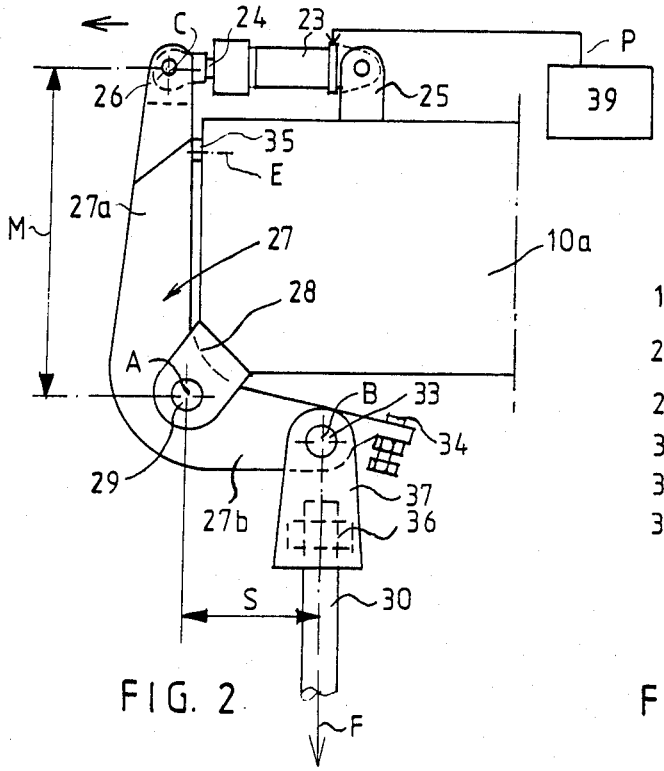
FIG. 2 is a detail view of apparatus illustrated in FIG. 1 on an enlarged scale and illustrating various pivot points and dimensions of a lever mechanism comprising a part of the apparatus.
Figure 3:
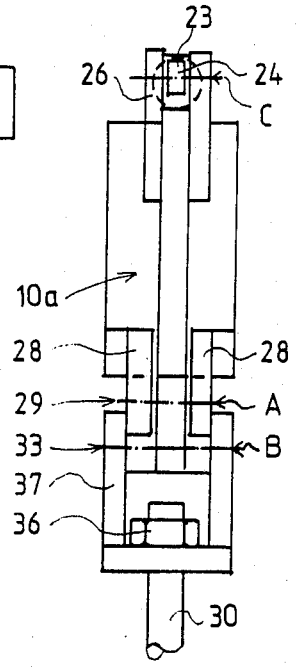
FIG. 3 is a side elevation view of the apparatus illustrated in FIG. 2 in the longitudinal direction of the cantilevered beam from outside the beam.

The principles of operation of a first embodiment of apparatus in accordance with the invention will now be described with reference to FIG. 2. A hydraulic cylinder 23 is attached to the upper side of the projecting part 10*a* of cantilevered beam 10 by a bracket 25. A piston rod 24 of the hydraulic cylinder is linked to the end of one arm 27*a* of a bellcrank lever 27 at point C by pin 26. Bellcrank lever 27 is pivotally connected to the projecting beam part 10*a* at point A by pin 29 and bracket 28. The lower arm 27*b* of the bellcrank lever 27 is linked to a draw bar 30 at point B by pin 33 and bracket 37. When the point B is held fixed and when the draw bar 30 is loaded by a tensile force F, the point A and the entire projecting part 10*a* of cantilevered beam 10 to which point A is fixed, attempts to turn downwardly so that the main body of beam 10 supported by the side frame 12 attempts to turn upwardly. In this manner, the desired pre-tensioning of the beam 10 is produced. The magnitude of the pre-tensioning can be adjusted by adjusting the position of a limiting screw 34. The required pre-tensioning force F can be set by adjusting the ratio of the dimensions S and M of the bellcrank lever 27 while the size of the loading cylinder 23 and the loading pressure P from pressure source 39 can be maintained constant. As an example, the dimension S may be 300 mm. while the dimension M may be 1000 mm. After the intermediate frame pieces 15 have been opened and the felts replaced, the pre-tensioning of the beam 10 can be released in accordance with the method of the invention by depressurizing the hydraulic cylinder 23 and by pivoting the bellcrank lever 27 against the limiting stop 35 at point E.

The principle of operation and the construction of the embodiment of the invention shown in FIG. 1 are similar to that described above. Referring to FIG. 1, the lower arm 27*b* of the bellcrank lever 27 is attached to the draw bar 30 by means of an articulated joint 33'. The draw bar 30 passes through a box bolster 31 mounted in the paper machine hall in the machine direction. The draw bar 30 is fixed by means of nuts 32 threaded over its lower end which bear against the lower surface of the box bolster 31. The embodiment of FIG. 2 differs from that of FIG. 1 in that the upper end of the draw bar 30 in the embodiment of FIG. 2 is connected to a forked bracket 37 by means of a nut 36, the bracket 37 being attached to the lower arm 27*b* of the bellcrank lever 27 at point B by means of an articulation shaft or pin 33. In other respects, the construction of the embodiment illustrated in FIG. 1 is the same as that illustrated in FIG. 2.

Figure 4:
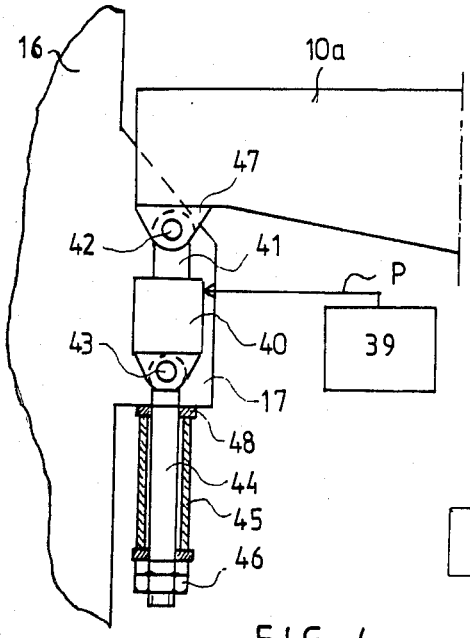
FIG. 4 is a view similar to FIG. 1 illustrating another embodiment of apparatus in accordance with the invention.

Another embodiment of the invention is illustrated in FIG. 4. In this embodiment, a piston rod 41 of a draw cylinder 40 is connected to the outer end of the projecting part 10*a* of cantilevered beam 10 by means of brackets 47 and an articulation pin 42. At its bottom end, the draw cylinder 40 is connected to the draw bar 44 by an articulation pin 43. The draw bar 44 passes through the box bolster 45 which is mounted in the machine hall in the machine direction. The draw bar 44 transfers the lifting force to the box bolster 45 by means of nuts 46. The flange 48 at the top end of the box bolster 45 bears against the lower flat side of the projecting part 17 of wall 16. When a certain pressure P is introduced into the draw cylinder 40 from a pressure source 39, the piston rod 41 retracts into the draw cylinder and tends to pull the projecting beam part 10*a* downwardly, whereby at a certain time, appropriate pre-tensioning is provided in cantilevered beam 10.

Figure 5:
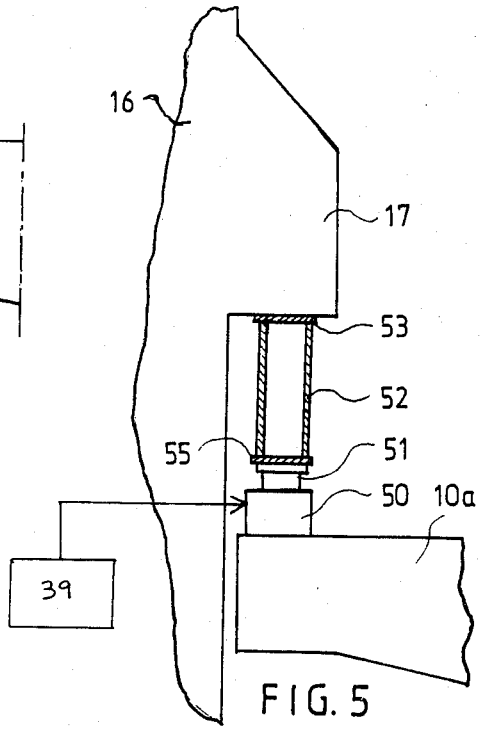
FIG. 5 is a view similar to FIGS. 1 and 4 illustrating still another embodiment of apparatus in accordance with the invention.

Referring now to FIG. 5, another embodiment of apparatus in accordance with the invention includes a lifting cylinder or jack 50 fixed to the top side of the projecting part 10*a* of cantilevered beam 10 while the lifting part 51 of the lifting cylinder 50 bears against the lower flange 55 of the box bolster 52 mounted on the machine hall in the machine direction. The upper flange 53 of box bolster 52 bears against the flat lower side of the projecting part 17 of wall 16. Upon pressurizing the lifting cylinder 50 with a pressure P from the pressure source 39, the lifting part or piston 51 pushes upwardly against the box bolster whereupon the pre-tension required in connection with the replacement of a felt or the like is provided in cantilevered beam 10. The pre-tension can also be released in a easy manner as will be understood.

It is a feature of the method of the invention that the power units 23, 40 and 50 are depressurized so that the cantilevered beam is not pre-tensioned during normal operation of the paper machine. When a felt or the like is to be replaced and the intermediate pieces 15 of the side frame 11 are opened by means of cranes or the like, a pre-tension of an appropriate magnitude is maintained in the cantilevered beam 10. The magnitude of the pre-tensioning is chosen so that the sag of the end of the cantilevered beam 10 situated at the service-side side frame 11 does not become unduly large. As a rule, the magnitude of the pressure P applied to the power units 23, 40, 50 when pre-tensioning is required does not require any regulation. Rather, and the magnitude of the pre-tensioning force F and magnitude of the deflection of the projecting part 10*a* of beam 10 in the downward direction are determined by mechanical devices. For example, in accordance with the embodiments of FIGS. 1 and 2, the limiting screw 34 provided at the end of the lower arm 27*b* of the bellcrank lever 27 can be adjustable to regulate the magnitude of the pre-tensioning force and deflection of the projecting beam part.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus in a cantilevered frame part of a press section and/or wire section of a paper machine located in a machine hall in which a cantilevered beam extends between side frames, said cantilevered beam including a projecting part, comprising:

a loading lever pivotally connected to said projecting part of said cantilevered beam;

power means mounted on said projecting part of said cantilevered beam for applying a force to said loading lever; and a pull/draw bar including one end pivotally connected to said loading lever and another end coupled to a stationary counter-member.

2. Apparatus as recited in claim 1 further including adjustable limiter means provided on said loading lever for limiting the magnitude of downward deflection of said projecting part of said cantilevered beam.

3. Apparatus as recited in claim 1 when said another end of said pull/draw bar is coupled to a stationary counter-member by coupling means including a bolster mounted in said machine hall in the machine direction having one end bearing against said stationary counter-member, said pull/draw bar passing through said bolster, and means connecting said another end of said pull/draw bar to another end of said bolster.

4. Apparatus as recited in claim 1 wherein said stationary counter member comprises a projecting part of a wall of said machine hall.

5. Apparatus as recited in claim 3 wherein said connecting means include threaded nut means fastened to said another end of said pull/draw bar.

* * * * *